US005622264A

United States Patent [19]

Wetterlund

[11] Patent Number: 5,622,264

[45] Date of Patent: Apr. 22, 1997

[54] GIFT BOX FOR MONETARY GIFTS

[76] Inventor: Moe (Maureen) Wetterlund, 19060 Pleasantview Rd., Eden Prairie, Minn. 55346

[21] Appl. No.: 585,382

[22] Filed: Jan. 11, 1996

Related U.S. Application Data

[63] Continuation of Ser. No. 493,710, Jun. 22, 1995, abandoned.

[51] Int. Cl.[6] ..... B65D 85/08

[52] U.S. Cl. ..... 206/765; 206/459.5; 206/391

[58] Field of Search ..... 206/756, 763, 206/764, 765, 775, 779, 459.5, 457, 391, 525, 526

[56] References Cited

U.S. PATENT DOCUMENTS

| | | | |
|---|---|---|---|
| Re. 21,592 | 10/1940 | Addis et al. | 206/44 |
| D. 307,719 | 5/1990 | Band | D9/432 |
| D. 323,851 | 2/1992 | Distant | D19/1 |
| D. 338,403 | 8/1993 | Hildebrand | D9/432 |
| D. 339,063 | 9/1993 | Simon | D9/433 |
| D. 339,389 | 9/1993 | Peppin | D21/84 |
| 1,352,759 | 9/1920 | Markert . | |
| 1,674,209 | 6/1928 | Lord . | |
| 1,812,311 | 6/1931 | Wolf . | |
| 1,838,411 | 12/1931 | Knorpp . | |
| 1,966,734 | 7/1934 | Rosen | 211/156 |
| 2,138,984 | 12/1938 | Rounds | 206/44 |
| 2,158,756 | 5/1939 | Knorpp | 206/44 |
| 2,637,299 | 5/1953 | Salkey | 120/23 |
| 2,672,980 | 3/1954 | Halbach | 206/65 |
| 2,797,806 | 7/1957 | Davis | 206/75 |
| 2,841,277 | 7/1958 | Paige | 206/62 |
| 2,967,009 | 1/1961 | Lidgard | 229/14 |
| 3,009,622 | 11/1961 | Leone | 229/16 |
| 3,058,585 | 10/1962 | Budd | 206/65 |
| 3,682,597 | 8/1972 | Husch | 23/259 |
| 4,025,039 | 5/1977 | Croll et al. | 229/27 |
| 4,184,592 | 1/1980 | Howard, Jr. | 206/327 |
| 4,434,890 | 3/1984 | Sieck et al. | 206/45.19 X |
| 4,503,972 | 3/1985 | Nelligan et al. | 206/379 |
| 4,610,348 | 9/1986 | Dailey | 206/45.19 |
| 5,046,609 | 9/1991 | Mangini et al. | 206/459.5 X |
| 5,121,838 | 6/1992 | Dickie | 206/334 |

*Primary Examiner*—Jacob K. Ackun
*Attorney, Agent, or Firm*—Gregory P. Kaihoi

[57] ABSTRACT

A gift box for a monetary girl. The gift box includes an outer shell with an openable top permitting access to the interior cavity. A removable insert is positioned within the cavity. The insert includes a platform having one or more apertures. The platform also includes printed graphic material, the apertures being coordinated with the position and content of the graphic material. A monetary gift may be rolled up and inserted through one or more of the apertures, the platform retaining the monetary gift in a generally vertical orientation.

12 Claims, 8 Drawing Sheets

GIFT BOX FOR MONETARY GIFTS

This application is a continuation of application Ser. No. 08/493,710, filed Jun. 22, 1995, now abandoned.

FIELD OF THE INVENTION

The invention relates to gift boxes, and in particular to a gift box designed for containing monetary gifts.

BACKGROUND OF THE INVENTION

A wide variety of packages have been created for various types of merchandise. In many circumstances, however, when an individual wishes to make a monetary gift, the gift is given in a card or envelope. In some circumstances, this is convenient and appropriate. Because of their flat nature, however, cards and envelopes are easier to misplace than three-dimensional boxes. Moreover, in many circumstances the anticipation present when one opens a three-dimensional box is entirely absent when one opens a card-either the recipient knows (because of the occasion) that a gift of money will be found in the card even before opening it, or the recipient opens the card without any anticipation that a substantive gift is being given. The latter circumstance often discourages the gift giver from giving a monetary gift, even when such a gift might be the most appropriate or convenient.

SUMMARY OF THE INVENTION

The invention provides a three-dimensional gift box for containing a monetary gift. The gift box includes an outer shell having a plurality of side walls, a top and a bottom together defining an interior cavity. The top and bottom are generally parallel to one another and spaced apart at least about two and five-eighths inches (the height of U.S. currency), and preferably about three inches. The top is openable and closable to permit access to the interior cavity to insert and remove the monetary gift.

A removable insert is positioned in the box's interior cavity, the insert including a platform which is oriented generally parallel to the top and bottom. The insert includes support means for supporting the platform in a position spaced away from both the top and the bottom by a distance of at least about three-quarters of an inch (preferably about one and a half inches). The insert includes a plurality of perforations defining a plurality of circular punch-out discs having a diameter of between about one-quarter inch and about three-quarters inch.

The platform includes a visibly perceptible graphic greeting printed thereon—in one embodiment, the greeting includes visibly perceptible indicia indicating a number corresponding to the gift-giving occasion, such as the age of an intended recipient, an anniversary, etc. The number and placement of the apertures in the platform preferably is coordinated with the position and content of the graphic greeting—for example, for a birthday gift for a ten-year old, the greeting may include a graphic depiction of the numeral "10", with the platform having ten punch-out discs arranged within the printing of the numeral "10" (the number of punch-out discs corresponding to the number of U.S. one dollar bills required to give a monetary gift equal to the number printed on the platform). When larger numbers are printed on the platform, the number of apertures may be some regular fraction of the number, thereby permitting a gift consisting of, e.g., five or ten dollar bills adding up to the number.

Thus, a corresponding number of currency bills may be individually rolled up and inserted through the platform in the regions defined by the perforations, thereby punching out the perforated discs. The platform holes retain the bills in a generally vertical orientation, displaying an interesting (and perhaps surprising) visual presentation to the gift recipient.

DETAILED DESCRIPTION OF THE INVENTION

Figure 1:
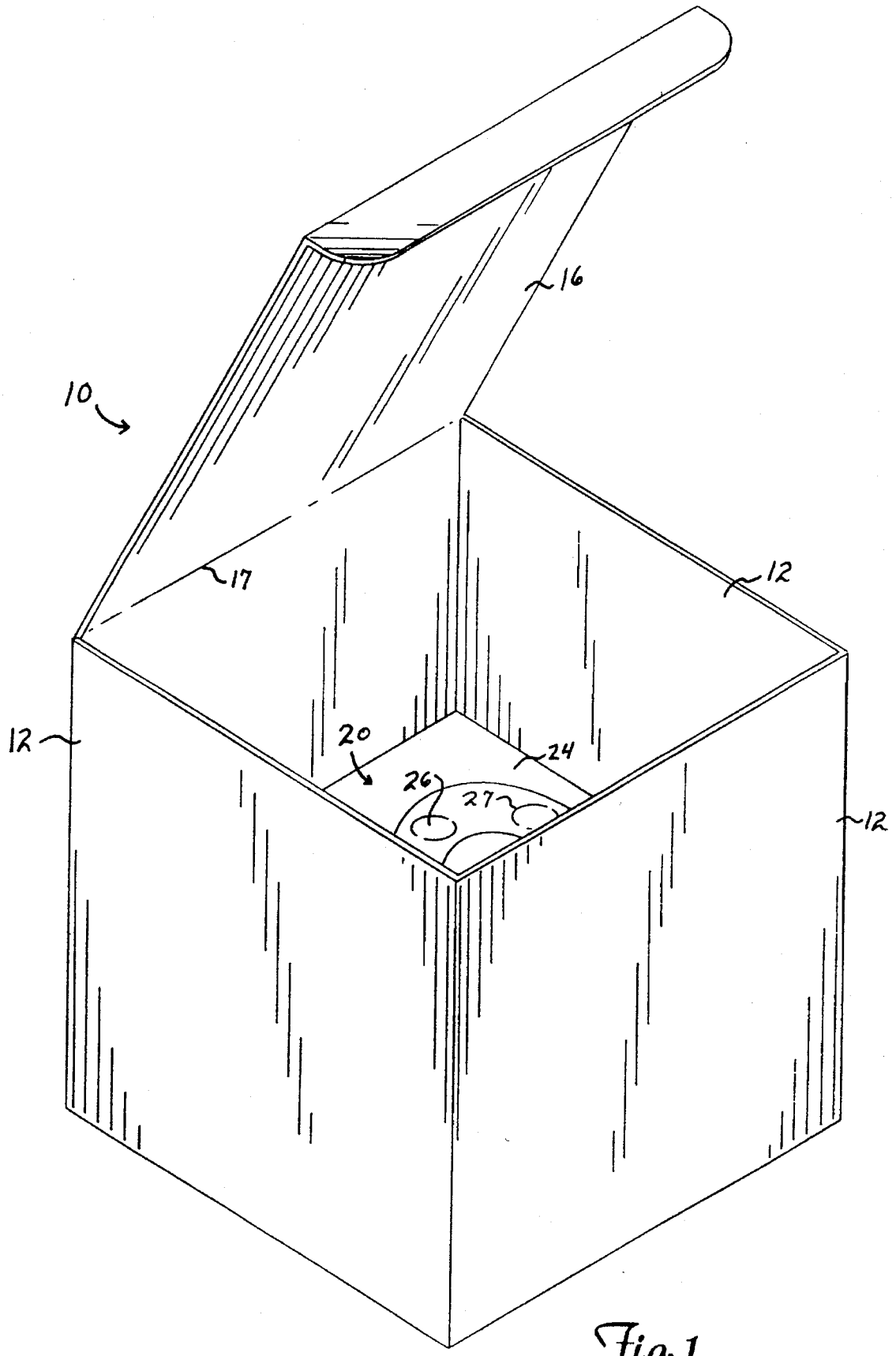
FIG. 1 is a perspective view of a money gift box of the invention.
Figure 2:
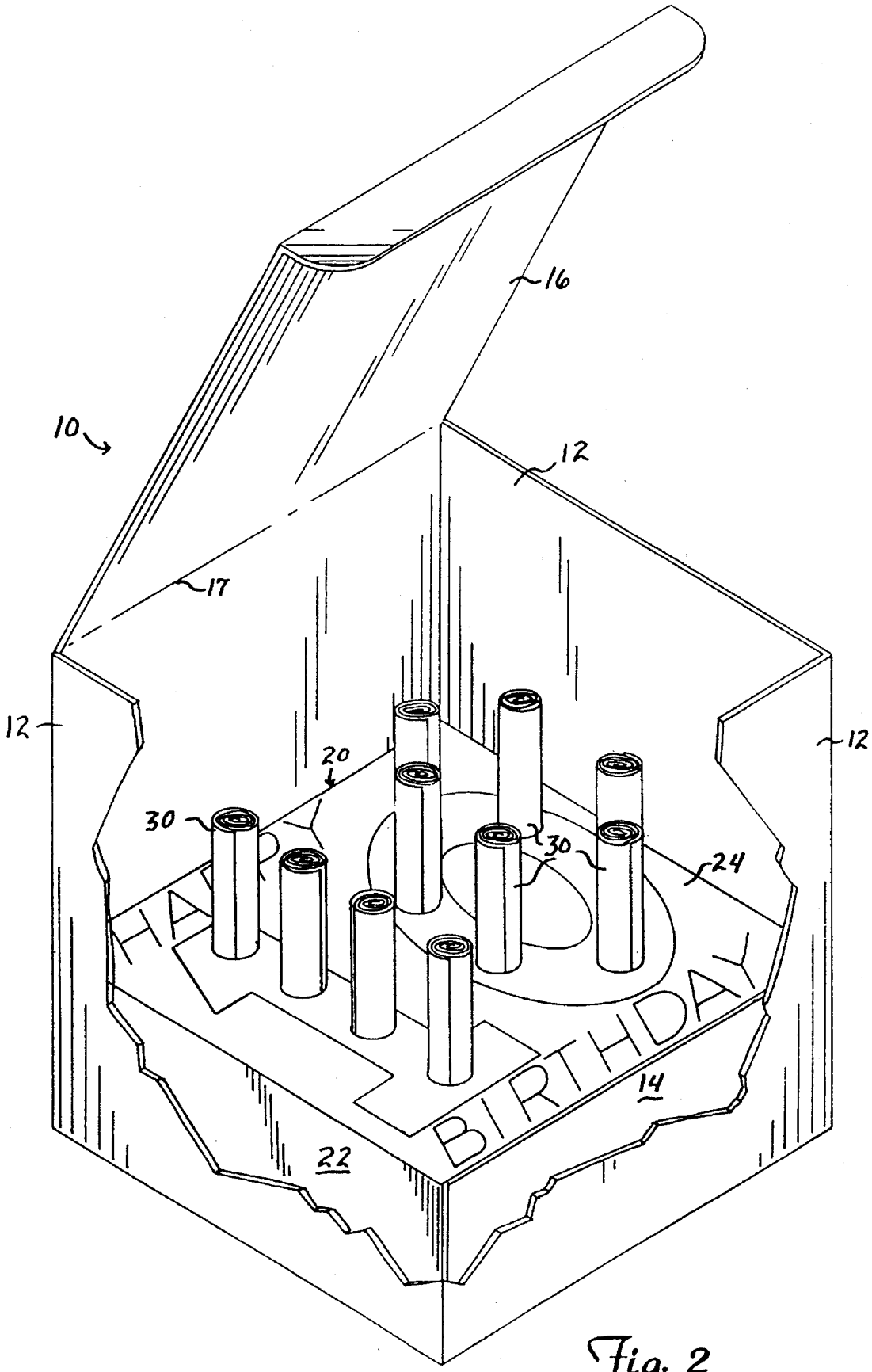
FIG. 2 is a partially broken-away view a money gift box containing a monetary gift.

FIG. 1 depicts a gift box 10 of the invention which is generally rectangular in configuration (i.e., rectangular in vertical elevational view, square in plan view). Other suitable shapes may also be used, such as cubical, triangular, pyramidal, and the like. The gift box includes side walls 12, a bottom 14, and a top 16. The preferred embodiment shown in FIGS. 1 and 2 depict the top as being connected to one of the side walls by a hinge 17; alternately, the top may be a separate piece from the box 10, the top including short side walls extending downwardly to snugly fit the cover to the box. Other equivalent arrangements could also be utilized to define a box enclosure for containing a monetary gift.

An insert 20 is contained within the box 10 for holding the monetary gift 30. The insert 20 includes a generally horizontally oriented platform 24 supported within the box enclosure spaced away from both the box top 16 and the box bottom 14. Preferably the platform is supported in a position spaced away from both the top 16 and the bottom 14 by a distance of at least about three-quarters of an inch (for reasons explained below), and preferably about one and a half inches.

The insert includes means for supporting the platform in its desired position. Although any suitable means may be employed, in a preferred embodiment illustrated in FIG. 2, the insert itself includes a pair of foldable legs 22 which are manufactured integrally with the platform. The legs 22 are folded downwardly so that the respective ends of the legs 22 engage the bottom 14 of the box 10 to support the platform at the desired distance above the bottom 14 of the box 10. Preferably the legs are at least about three-quarters of an inch long (preferably about an inch and a half) to give the desired spacing referred to above. Other suitable means could also be employed to yield the desired support and spacing for the platform 24.

Figure 4:
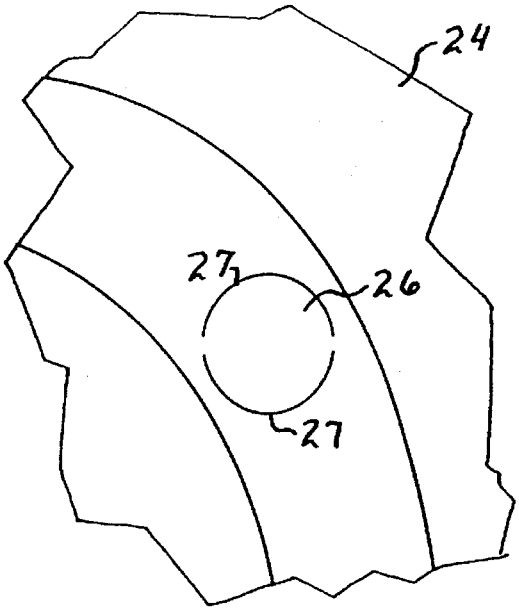
FIG. 4 is a broken-away view of a portion of the insert of FIG. 3, depicting a perforation in the insert.

The platform 24 is provided with a plurality of perforations 27 (see FIG. 4) defining a corresponding plurality of potential holes 26 into which the monetary gift 30 may be placed. Preferably each circular hole 26 is defined by two substantially semi-circular perforations. Other configurations of perforations may also be used, however. The perforations 27 are formed to define a particular pattern of holes or punch-out discs 26 which coordinates with printed matter appearing on the platform 24 of the insert 20—i.e., the platform includes a visibly perceptible graphic greeting printed on it, and the number and placement of the apertures in the platform is coordinated with the position and content of the graphic greeting.

Figure 3:
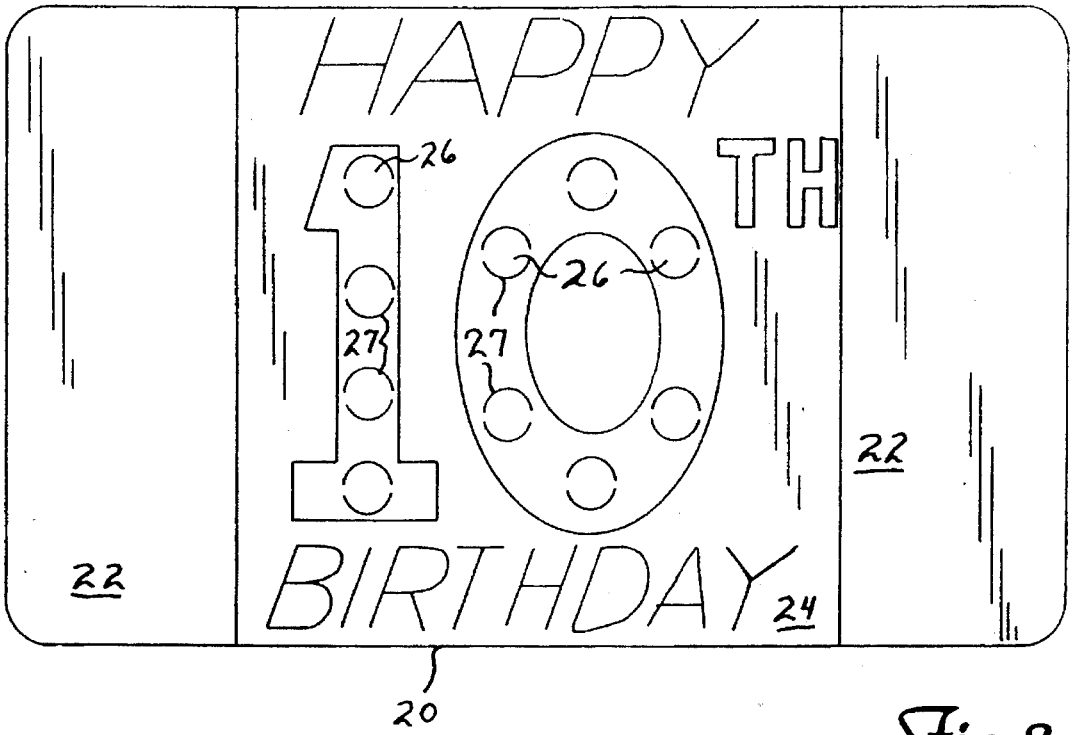
FIGS. 3 is a plan view of the removable insert contained in the money box depicted in FIGS. 1 and 2.

For example, FIGS. 2–3 depict an insert having the message "Happy 10th Birthday" printed on it. By the present invention, it is contemplated that monetary gift corresponding to this insert would be $10. Thus, the insert is provided with ten perforated holes 26 into which ten $1 bills may be placed—each dollar bill is rolled up and inserted through the perforations 27, thereby dislodging the punch-out discs 26 defined by the perforations 27. Desirably the punch-out discs have a diameter of between about one-quarter inch and about three-quarters inch (preferably about five-eighths inch). Desirably the discs are not actually punched out during manufacture, but are left intact for the user to remove as the monetary gift is inserted so that, if desired, the user may give a monetary gift that does not utilize all of the perforated holes. In this fashion, unused punch-out discs are left intact, so that the platform does not have any empty, open holes when the gift is given.

The platform and insert thus provide a three-dimensional presentation of the monetary gift in a very aesthetically pleasing manner. The gift box of the invention also presents the monetary gift in a manner that is probably surprising to the gift recipient—currently most monetary gifts are given in flat envelopes, and, thus, not only is the recipient surprised that the three dimensional box contains a monetary gift, but the manner of presentation of the money is also aesthetically unique. Moreover, packaging the monetary gift in a three dimensional box also tends to alleviate the rather common risk of loss associated with conventional flat envelopes, since it is generally harder to lose or misplace a three dimensional box than a flat envelope. (The box, may, nevertheless, be sold at retail in a flat form, with the customer reconfiguring the box into its three dimensional form for use.)

Figure 5A:
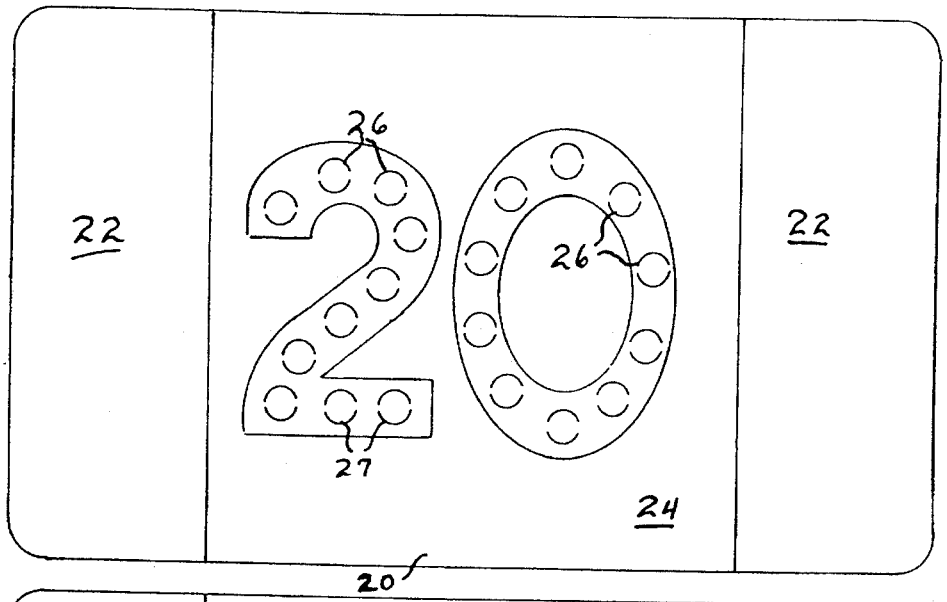
FIGS. 5A–5C are plan views of alternate inserts usable in the money gift box of the invention.
Figure 5B:
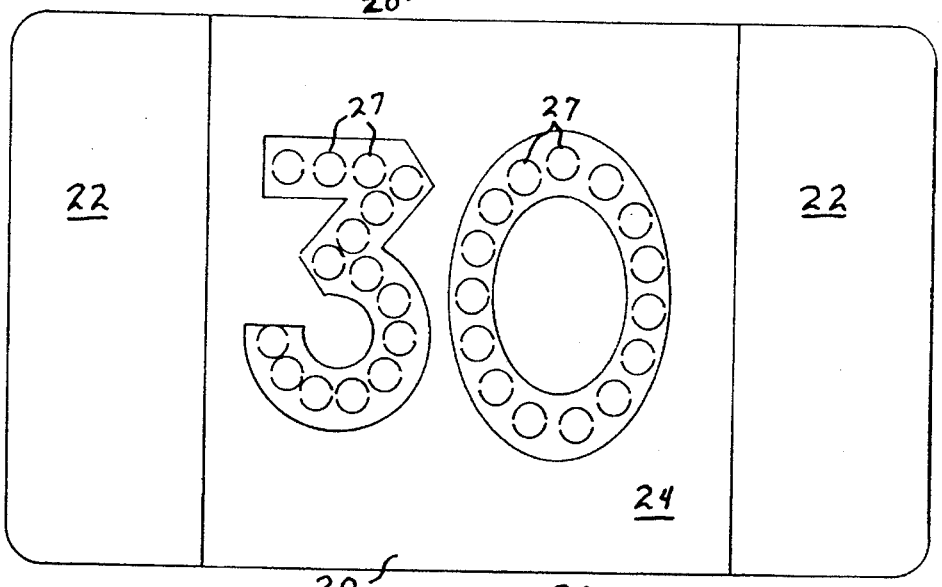
Figure 5C:
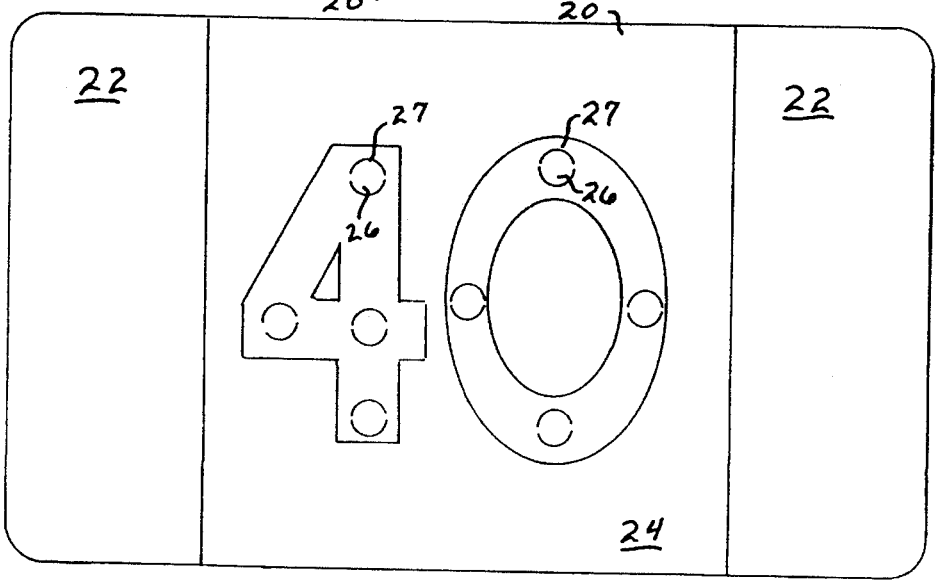
Figure 6:
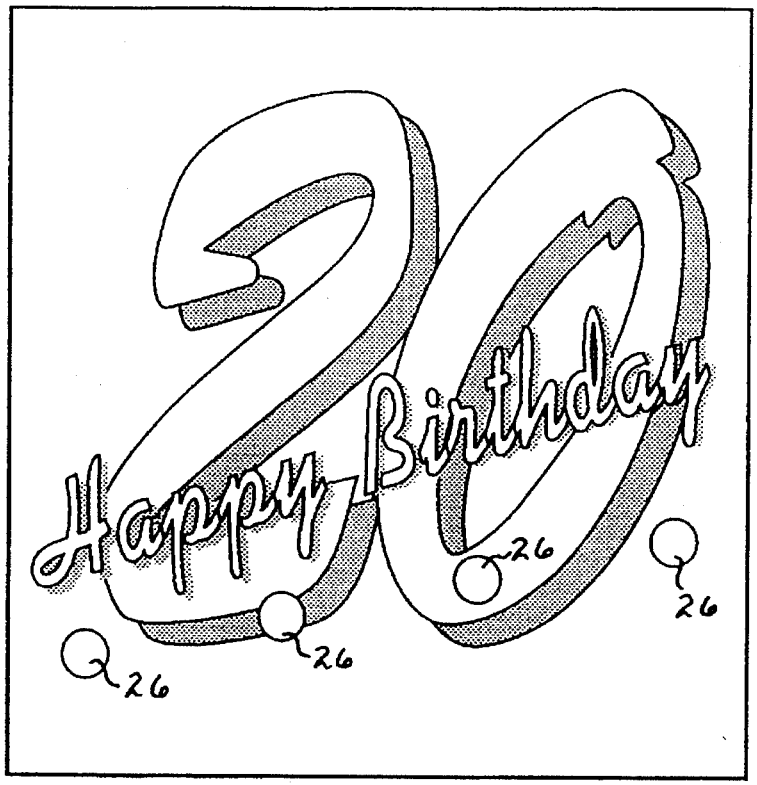
FIGS. 6–13 depict alternate graphical designs and greetings that may be printed on inserts used in the invention.
Figure 7:
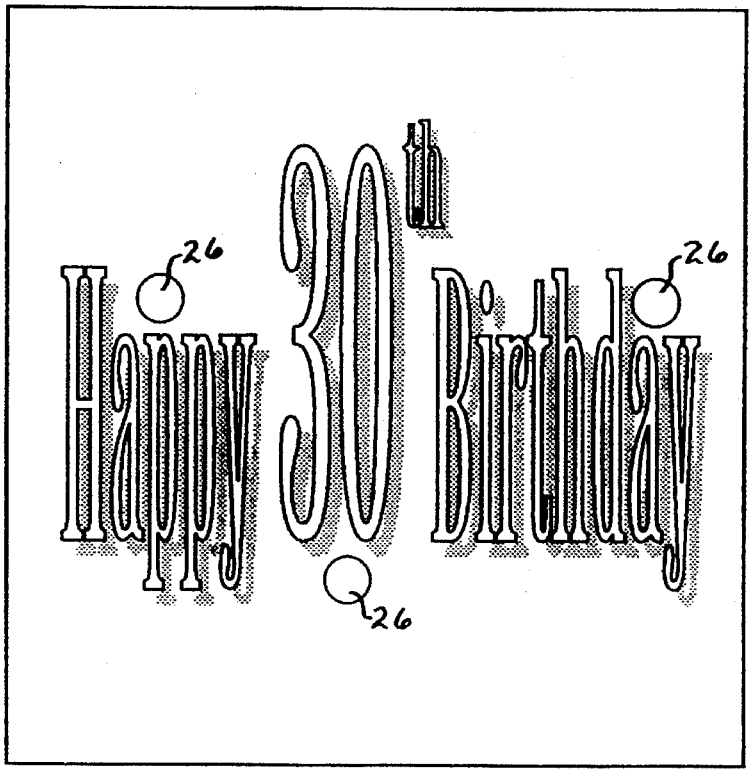
Figure 8:
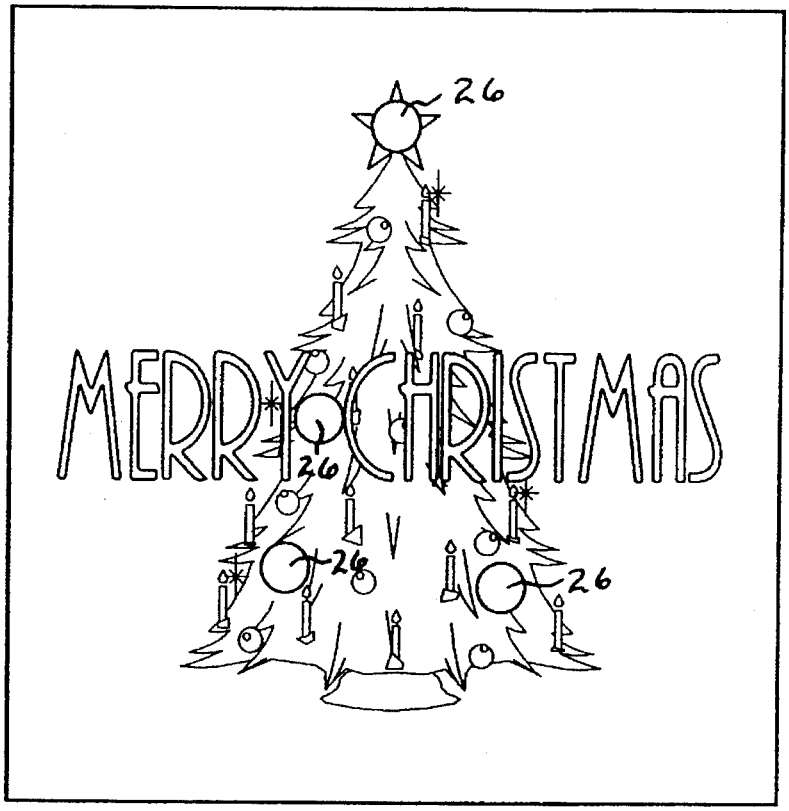
Figure 9:
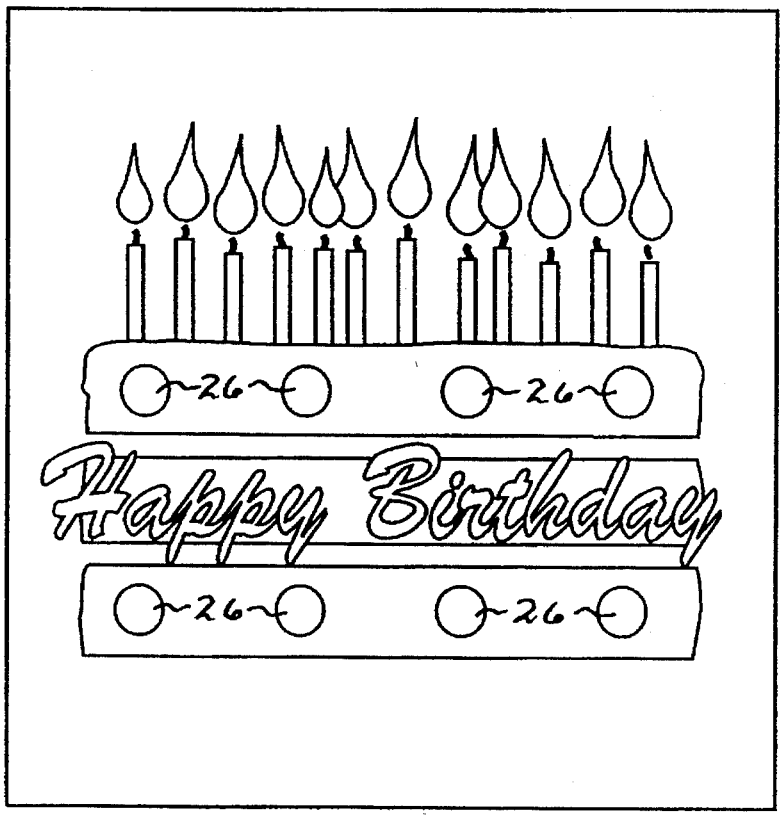
Figure 10:
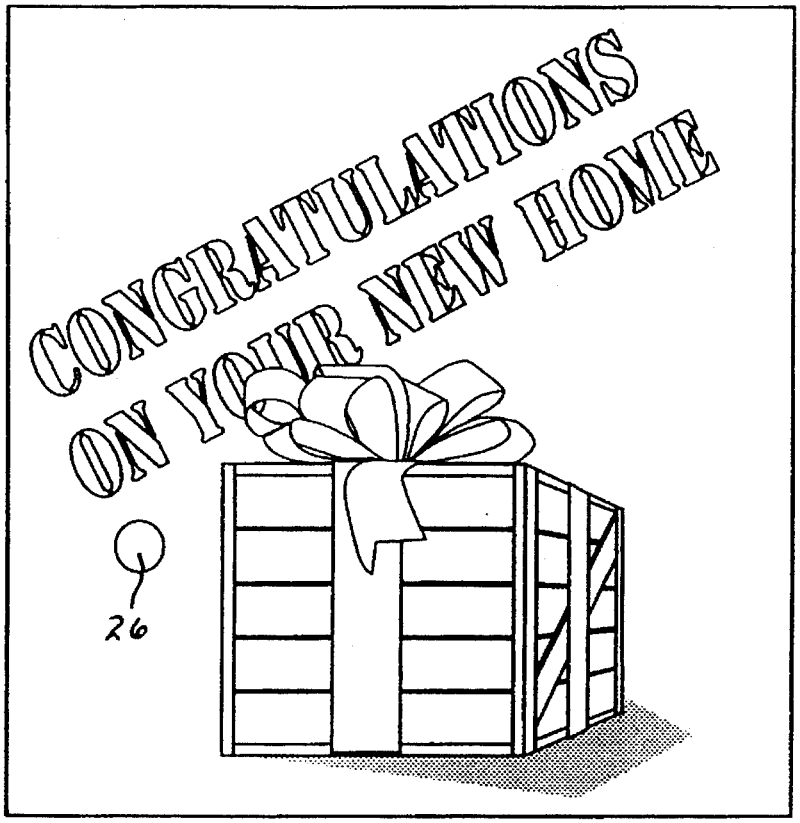
Figure 11:
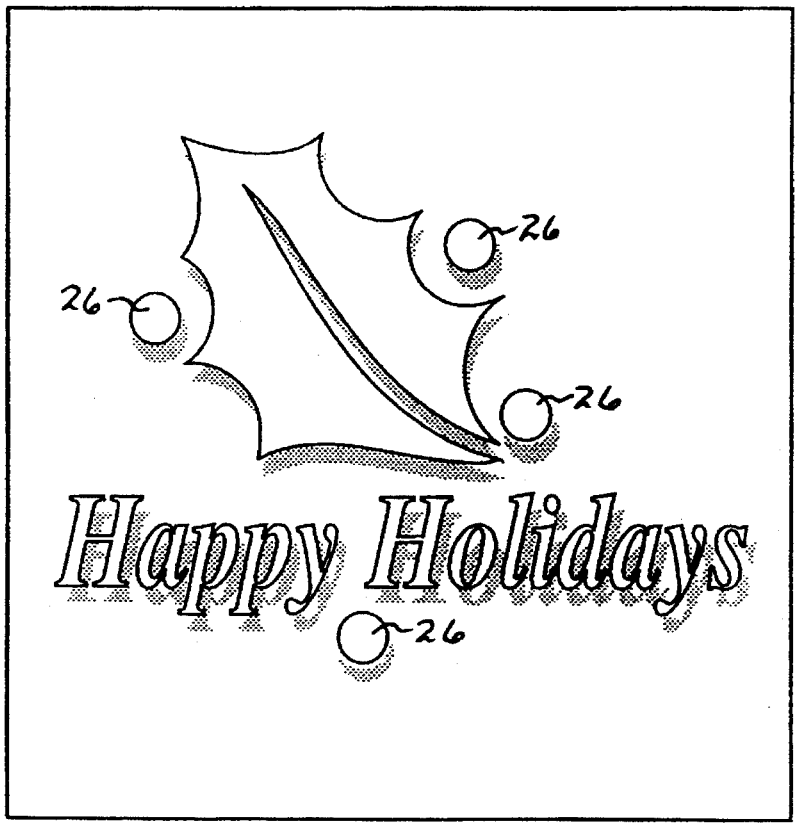
Figure 12:
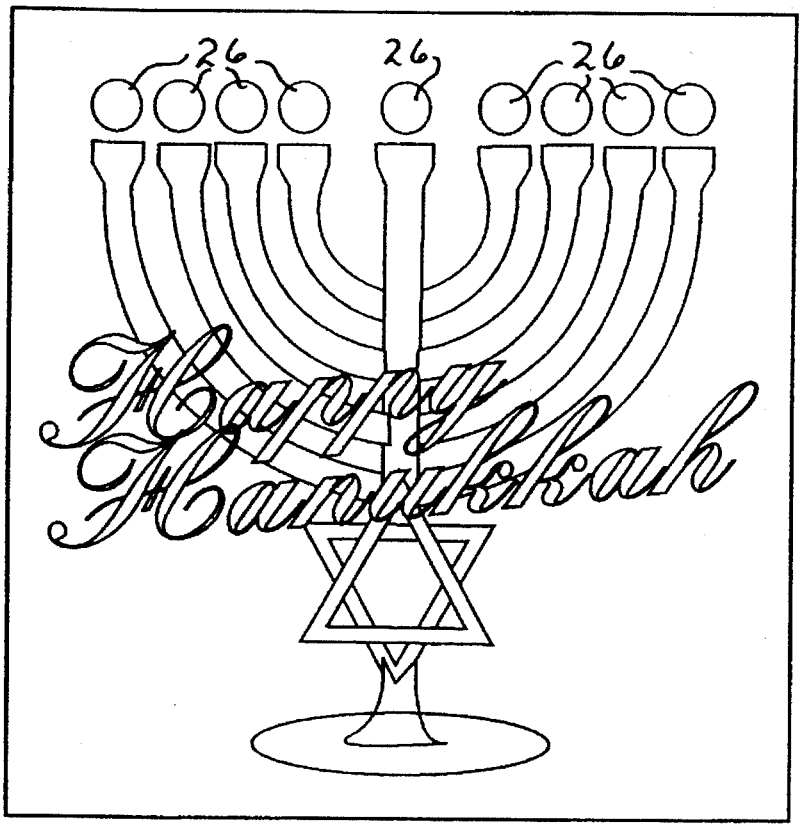
Figure 13:
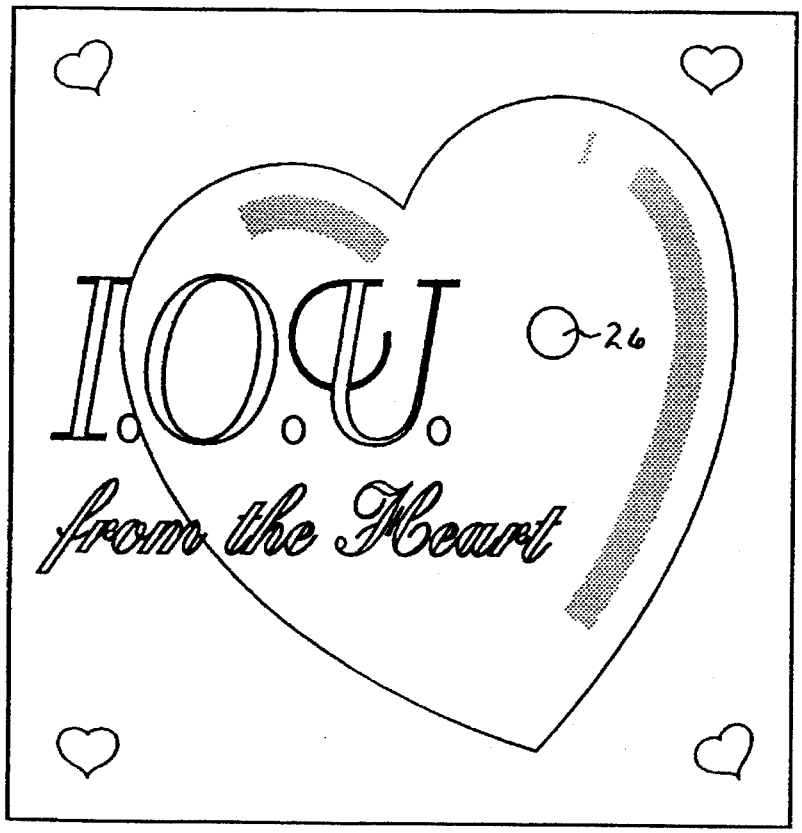

FIGS. 5A–5C illustrate additional inserts that may be utilized in connection with the invention. These inserts are printed with birthday messages corresponding to the age of the recipient, and contain a corresponding number of perforated holes to permit the giver to insert a monetary gift in U.S. paper currency which is equal (or proportional) to the recipient's age. Notice that FIG. 5C utilizes eight holes rather than forty, thus enabling the giver to give eight $5 bills rather than forty $1 bills. Other configurations may also be employed that would, for example, utilize $10 bills or other denominations (or combinations of denominations). Gift certificates or checks may also be utilized in lieu of actual currency in giving a monetary gift in the gift box of the invention.

FIGS. 6–13 depict additional greetings that may be printed on the insert, the drawings indicating with one or more circles the number and placement of the apertures 26 in the platform and the coordination of them with the position and content of the graphic greeting.

While a preferred embodiment of the present invention has been described, it should be understood that various changes, adaptations and modifications may be made therein without departing from the spirit of the invention and the scope of the appended claims.

What is claimed is:

1. A gift box for containing a monetary gift, comprising:

an outer shell having a plurality of side walls, a top and a bottom together defining an interior cavity, the top and bottom being generally parallel to one another and spaced apart at least about two and five-eighths inches, the top being openable to permit access to the interior cavity;

a removable insert positionable within the interior cavity, the insert including a platform oriented generally parallel to the top and bottom and including support means for supporting the platform in a position spaced away from both the top and the bottom by a distance of at least about three-quarters of an inch, the insert including a plurality of perforations defining a plurality of circular punch-out discs having a diameter of between about one-quarter inch and about three-quarters inch; and the platform including visibly perceptible indicia indicating a number corresponding to the age of an intended recipient, the number of punch-out discs in the platform corresponding to the number of U.S. paper currency bills required to give a monetary gift equal to the number represented by the visibly perceptible indicia;

whereby the corresponding number of currency bills may be individually rolled up and inserted through the platform in the regions defined by the perforations, thereby removing the circular punch-out discs, the platform retaining the bills in a generally vertical orientation.

2. The gift box of claim 1 wherein the number of punch-out discs in the platform is equal to the number of one dollar bills required to give a monetary gift equal to the number represented by the visibly perceptible indicia.

3. The gift box of claim 1 wherein the number of punch-out discs in the platform is equal to the number of five dollar bills required to give a monetary gift equal to the number represented by the visibly perceptible indicia.

4. The gift box of claim 1 wherein the number of punch-out discs in the platform is equal to the number of ten dollar bills required to give a monetary gift equal to the number represented by the visibly perceptible indicia.

5. The gift box of claim 1 wherein each circular punch-out disc is defined by two substantially semi-circular perforations.

6. A gift box for containing a monetary gift, comprising:

an outer shell having a plurality of side walls, a top and a bottom together defining an interior cavity, the top and bottom being generally parallel to one another and spaced apart at least about two and five-eighths inches, the top being openable to permit access to the interior cavity;

a removable insert positionable within the interior cavity, the insert including a platform oriented generally parallel to the top and bottom and including support means for supporting the platform in a position spaced away from both the top and the bottom by a distance of at least about three-quarters of an inch, the insert including perforations defining one or more potential apertures having a diameter of between about one-quarter inch and about three-quarters inch; and the platform including a visibly perceptible graphic greeting printed thereon, the number and placement of the perforated potential apertures in the platform being coordinated with the position and content of the graphic greeting;

whereby currency bills may be individually rolled up and inserted through the perforated potential apertures in the platform, the platform retaining the bills in a generally vertical orientation so that the graphic greeting is substantially visually unobstructed by the monetary gift contained in the gift box.

7. A gift box containing a monetary gift, comprising:

an outer shell having a plurality of side walls, a top and a bottom together defining an interior cavity, the top and bottom being generally parallel to one another and spaced apart at least about two and five-eighths inches, the top being openable to permit access to the interior cavity;

a removable insert positionable within the interior cavity, the insert including a platform oriented generally parallel to the top and bottom and including support means for supporting the platform in a position spaced away from both the top and the bottom by a distance of at least about three-quarters of an inch, the insert including one or more apertures having a diameter of between about one-quarter inch and about three-quarters inch;

the platform including a visibly perceptible graphic greeting printed thereon, the number and placement of the apertures in the platform being coordinated with the position and content of the graphic greeting; and a monetary gift rolled up and inserted through one or more of the apertures in the platform, the platform retaining the monetary gift in a generally vertical orientation.

8. The gift box of claim 7 wherein the number of apertures in the platform is equal to the number of one dollar bills required to give a monetary gift equal to the number represented by the visibly perceptible graphic greeting.

9. The gift box of claim 7 wherein the number of apertures in the platform is equal to the number of five dollar bills required to give a monetary gift equal to the number represented by the visibly perceptible graphic greeting.

10. The gift box of claim 7 wherein the number of apertures in the platform is equal to the number of ten dollar bills required to give a monetary gift equal to the number represented by the visibly perceptible graphic greeting.

11. The gift box of claim 7 wherein the monetary gift comprises U.S. paper currency.

12. The gift box of claim 7 wherein the monetary gift comprises one or more gift certificates.

* * * * *